United States Patent [19]

Boyett

[11] Patent Number: 5,027,936

[45] Date of Patent: Jul. 2, 1991

[54] COIN SLIDE WITH MEANS FOR REJECTING MAGNETIC COINS

[76] Inventor: Timothy E. Boyett, 5132 Cavalier Dr., Mableton, Ga. 30059

[21] Appl. No.: 390,374

[22] Filed: Aug. 7, 1989

[51] Int. Cl.[5] ..... G07D 5/08

[52] U.S. Cl. ..... 194/325; 194/238

[58] Field of Search ..... 194/320, 321, 325, 235, 194/238

[56] References Cited

U.S. PATENT DOCUMENTS

| | | | |
|---|---|---|---|
| 799,045 | 9/1905 | Grover | 194/320 X |
| 1,109,690 | 9/1914 | Merkle | 194/321 |
| 1,957,091 | 5/1934 | Block | 194/320 X |
| 2,026,921 | 1/1936 | Tratsch et al. | 194/320 X |
| 2,233,653 | 3/1941 | Tratsch | 194/320 |
| 3,602,352 | 8/1971 | Robinson | 194/238 |
| 3,732,962 | 5/1973 | Hall | 194/238 |
| 3,887,054 | 6/1975 | Allen | 194/238 |
| 3,978,960 | 9/1976 | Mellinger et al. | 194/235 |
| 4,221,285 | 9/1980 | Greenwald et al. | 194/238 |

*Primary Examiner*—Robert J. Spar
*Assistant Examiner*—William M. Hienz
*Attorney, Agent, or Firm*—Thomas, Kerr & Kayden

[57] ABSTRACT

A coin slide [10] is provided having an apparatus for rejecting magnetic coins and magnetic slugs and comprises a housing [11], a mounting flange [12] and a track [16]. A slide or carrier [21] is slidably received within the track [16] and has slots [23] for carrying coins standing vertically on edge along a horizontal coin path. A cylindrical permanent magnet [33] is positioned above the coin path for lifting magnetic coins and magnetic slugs at least partly out of the coin path to prevent the slide from carrying the coins farther along the coin path. An elongated cylindrical stop [34] provides a positive barrier against which magnetic coins and slugs which have been lifted by the magnet can engage to prevent further insertion of the slide [21].

12 Claims, 2 Drawing Sheets

COIN SLIDE WITH MEANS FOR REJECTING MAGNETIC COINS

TECHNICAL FIELD

This invention relates generally to coin testing and rejecting devices, and more particularly, to coin slides of the type that have means for rejecting magnetic coins and slugs.

BACKGROUND OF THE INVENTION

In coin operated machines, such as pay phones, game machines, laundry machines, and food and beverage vending machines, financial losses resulting from the use of slugs, tokens and foreign coins, all hereinafter referred to as slugs, may be substantial. Many such vending machines have a coin slide for accepting coins and for activating the machine in which the coins are moved along a generally horizontal coin path by a slide or carrier. The carrier is typically configured to carry one or more coins in either a flat, horizontal orientation or in a vertical, on-edge orientation. Coin slides usually have means for detecting and rejecting coins or slugs of the wrong diameter and thickness.

Many such slugs contain magnetic material, and are hereinafter referred to as magnetic slugs or magnetic coins. In the field of vertical drop coin boxes in which coins are pulled downwardly by gravity through a fairly complex coin path, it has been known to use magnets to detect and reject magnetic slugs. For example, U.S. Pat. No. 3,452,849 teaches a device for preventing the use of magnetic slugs in vertical drop coin boxes and which employs magnets positioned to guide the movement of a magnetic slug along a slightly different coin rejection path as it falls to prevent it from reaching a coin acceptance station in which the vending machine is activated. However, this has proven difficult to apply to coin slides because it is often impractical to provide coin slides with a separate slug rejection path through which the magnetic slugs may be removed.

U.S. Pat. No. 4,315,567 discloses an apparatus for rejecting slugs rolling along a horizontal coin path where the magnetic content of the slug exceeds a selected threshold. Here a pair of movable magnets, when attracted by a magnetic coin, move into a position to permit passage of slightly magnetic coin, and moves to block the coin path when the desired magnetic threshold is exceeded. The moving magnets together with the related movement mechanism make it impractical to apply this to a coin slide in which several coins are carried side by side along parallel coin paths. In addition, the complexity resulting from moving parts increases the likelihood of malfunction as well as necessitating careful calibration.

Accordingly, it is seen that a need remains for a simple and reliable device for rejecting magnetic slugs in a coin slide of the type in which one or more coins are moved along a path by a carrier. It is to the provision of such, therefore, that the present invention is primarily directed.

SUMMARY OF THE INVENTION

In a preferred form of the present invention, a coin slide comprises a track and carrier means mounted to the track for reciprocal movement for carrying a coin in an upright orientation along a path of travel from a coin receiving station through a coin rejection station to a coin acceptance station. The carrier means includes a coin engaging portion for retracting a coin. Magnet means are positioned at the coin rejection station for attracting and holding coins or slugs that contain magnetic material as the carrier means is advanced towards the acceptance station. Stop means are also positioned at the coin rejection station above the coin path and spaced from the magnet means.

So constructed, the coin carrier rejects magnetic slugs placed in the carrier in as much as when such a slug is moved along the path, it passes near to the magnet and is attracted thereto. The magnet holds the magnetic slug, and as the carrier continues to move the magnetic slug forward, the slug rolls about the magnet and engages the stop means so that its movement and that of the carrier along the path is thereby arrested. As the carrier is withdrawn, the magnetic slug rolls back about the magnet and away from the stop. As the carrier is completely withdrawn, the coin engaging portion of the carrier detaches the slug from the magnet and carries it back to the coin receiving station. Reliable rejection of magnetic slugs is achieved without the use of moving parts other than the coin or slug and the carrier, hence the likelihood of malfunctions occurring is slight.

DETAILED DESCRIPTION

Figure 1:
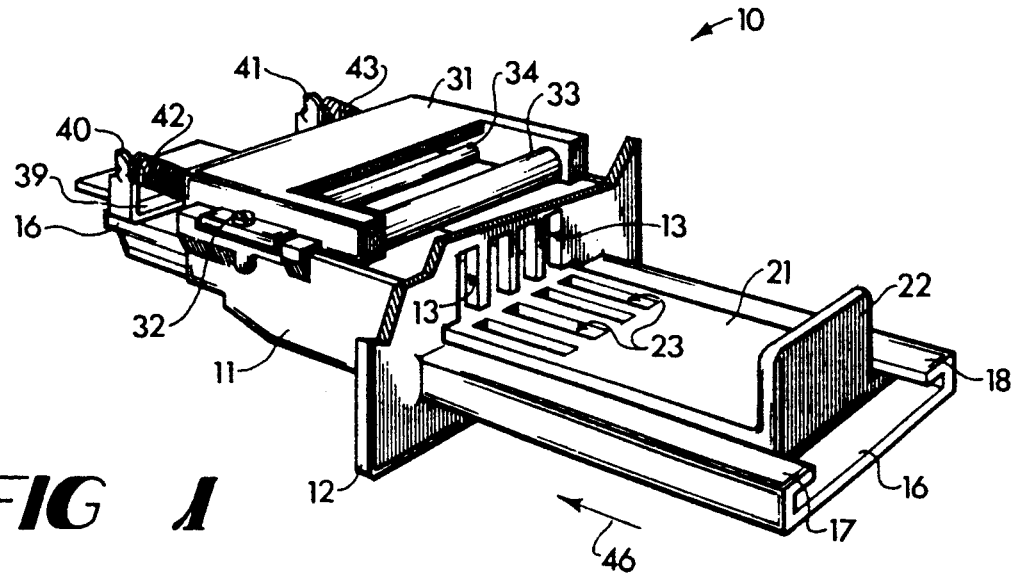
FIG. 1 is a perspective illustration of a coin slide embodying principles of the present invention in a preferred form.
Figure 2A:
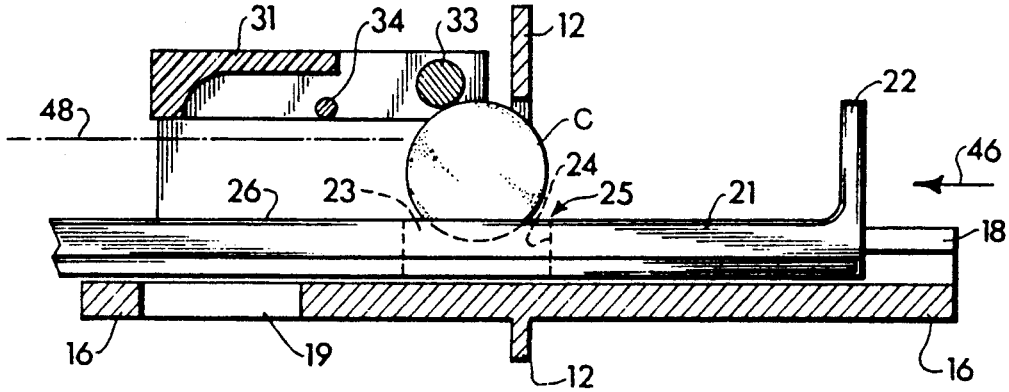
FIGS. 2A–2E are partially cut away side elevation views of the coin slide of FIG. 1 showing a sequence of positions of a portion of the coin slide as a magnetic slug is inserted, rejected and withdrawn.
Figure 2B:
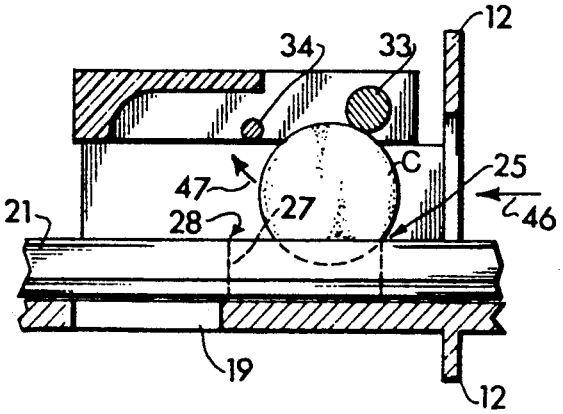
Figure 2C:
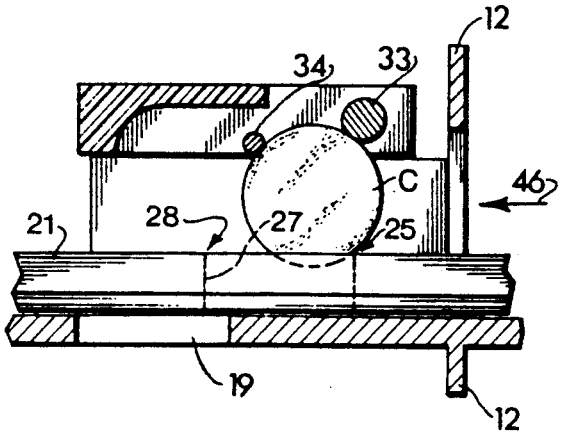
Figure 2D:
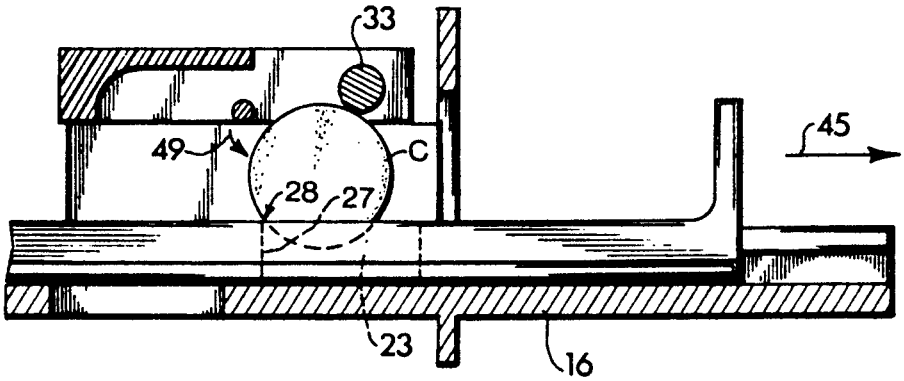
Figure 2E:
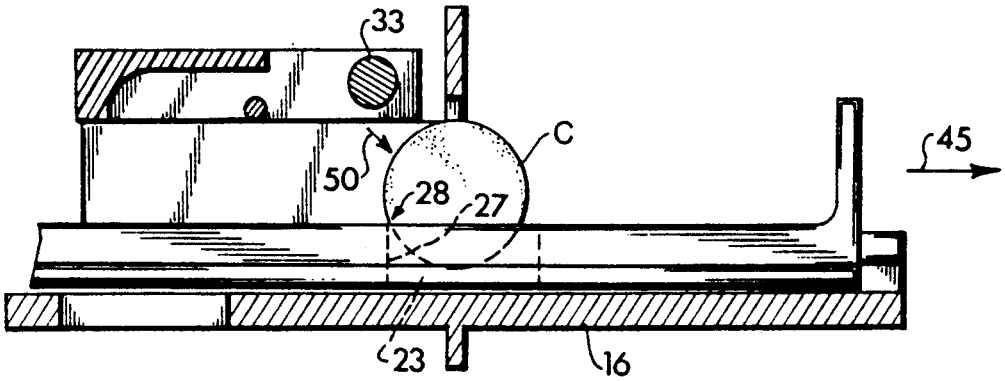
Figure 3:
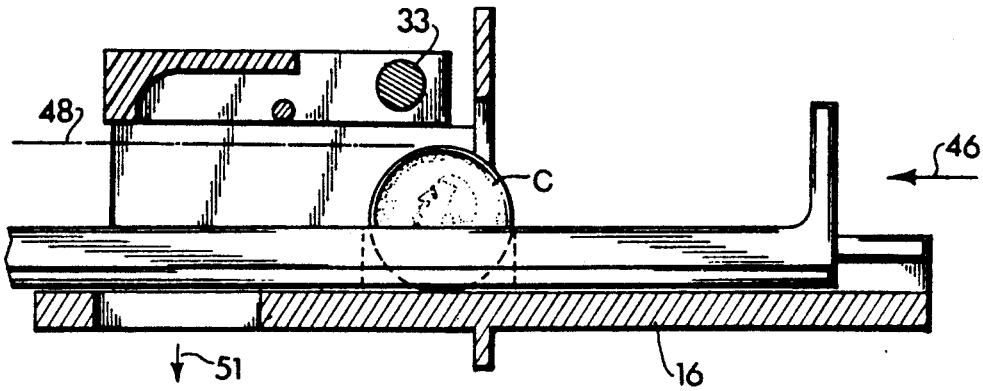
FIG. 3 is a partially cut away side elevation view of the coin slide of FIG. 1 showing a non-magnetic coin being inserted therethrough.

Referring now in more detail to the drawing figures, in which like numerals represent like parts throughout the several views, there shown in FIGS. 1–3 a coin slide 10 embodying principles of the present invention in a preferred form. The coin slide is shown partially cut away for clarity of illustration and is seen to have a housing 11 and a medial mounting flange 12 configured for mounting to the face of a vending machine. The mounting flange 12 has four openings or gates 13 for allowing coins standing vertically on edge to pass therethrough. The number of gates, of course, is selected to at least equal the number of coins required to operate the machine.

An elongated track or channel 16 is mounted to and extends through the mounting flange 12. A coin outlet port 19 is formed in a rearward portion of the track 16 and extends therethrough. The track has upper side ledge portions 17 and 18 which overlie portions of a coin carrier 21.

The coin carrier 21 is slidably mounted within the track 16 for reciprocal movement between the extended coin receiving position shown in FIG. 1 and an inserted coin acceptance position in which operation of a vending machine is enabled, as hereinafter described in detail. The carrier has a push handle 22 and vertical coin slots 23 for receiving and holding coins in upright, side by side positions. The slots 23 are aligned with the gates 13. Each slot 23 has front and rear walls 27 and 24 which extend to the upper surface 26 of the carrier. The front and rear walls 27 and 24 each have upper edges 28 and 25, respectively.

A cover or bridge 31 is mounted to an upper portion of the housing 11 by screws 32. An elongated, cylindrical, permanent magnet 33 is mounted to the cover 31 transversely above the track 16. An elongated, rigid, cylindrical stop 34 is mounted in juxtaposition with the magnet 33. The magnet 33 and the stop 34 are mounted relative to each other a distance apart selected to prevent coins carried uprightly on carrier 21 from passing therebetween. In other words, where the coin slide is designed for use with quarters, the magnet and stop are spaced apart a distance less than the diameter of a quarter. The stop 34 is similarly spaced above the upper surface 26 of the carrier less than diameter of the coin.

If the coin slide is to be used with two or more denominations of coins at the same time, the magnet 33 may be modified to have a stepped profile corresponding to the different diameters of the coins. It may also be necessary to modify the stop 34 in a similar fashion.

Finally, a bracket 39 is mounted to an end of the carrier 21 opposite the push handle 22. The bracket 39 has a pair of upright lugs 40 and 41 to which a pair of return springs 42 and 43 are connected with their opposite ends being anchored to the housing 11. The return springs urge the carrier toward the coin receiving station of FIG. 1, and upon insertion of the carrier, help to return the carrier to the coin receiving station.

OPERATION

The coin slide operates as follows. Coins C are deposited into the vertical slots 23 in the carrier 21 with the carrier in the extended coin receiving position shown in FIG. 1. By placing the appropriate number of coins of the proper denomination in the coin slots 23, and advancing the carrier 21 in the direction of arrow 46 by pushing on the push handle 22, an unshown vending machine is activated if the carrier reaches a coin acceptance station. The coin slide 10 has unshown conventional means for allowing only coins of an appropriate diameter and/or thickness to pass from the coin receiving station through the coin slide to activate the vending machine.

As the carrier 21 is advanced in the direction of arrow 46, coins C carried within the slots 23 slide upon or roll along an upper surface of the track 16. If all of the coins being carried by the carrier 21 are nonmagnetic and are of the appropriate size, the coins and the carrier 21 pass to a position in which the slots 23 overlie the outlet port 19. With the slots and the port now aligned, the coins carried by the carrier 21 fall through the carrier slots 23 and through the track outlet port 19, in the direction of arrow 51 of FIG. 3, and are collected in an unshown coin collection box mounted below the outlet port. The coins and the carrier having progressed this far in the direction of arrow 46 activate the vending machine in a conventional manner.

Should one or more of the coins being carried by the carrier 21 be a magnetic slug, the coin slide prevents the carrier from carrying the coins to the coin acceptance position in which the coins are allowed to drop through the slots 23 and through the outlet port 19. This is accomplished as follows. As the carrier 21 carrying coins is moved from the coin receiving station toward the coin rejection station, as shown in FIGS. 2A–2C, the coins are moved along a generally horizontal coin path. As a magnetic slug passes under the elongated, cylindrical magnet 33, the magnetic slug is attracted thereto and is lifted by the magnet slightly out of the slot 23. The magnetic slug is at least partly lifted above the normal coin path. The normal or usual coin path is shown to have an upper boundary shown in dashed line 48, as seen in FIG. 2A and FIG. 3. The magnet is selected of a magnetic strength sufficient to lift the magnetic slug into engaging contact with the magnet as shown in FIG. 2A.

As the slide is moved farther from the position of FIG. 2A toward the position of FIG. 2B, the magnet maintains contact with the edge of the slug C. The edge 25 of wall 24 of the vertical coin slot 23 pushes on the slug C and thereby causes it to rotate upwardly and about the magnet 33 in the direction of direction arrow 47. As the carrier 21 is further moved in the direction of arrow 46, the magnetic slug is moved into engagement with the stop 34, as shown in FIG. 2C. The magnetic slug is thereby prevented from progressing any further in the direction of arrow 46. As a consequence of the arrest of movement of the slug C, the carrier 21 is likewise prevented from moving further in the direction of arrow 46, as the spacing between the stop 34 and the upper surface 26 of the carrier is less than the diameter of the coin. Thus, the stop 34 uses the magnetic slug itself to prevent further movement in the direction of arrow 46 of both the magnetic slug and the carrier 21.

As the carrier 21 is withdrawn, the magnetic slug attracted to and in contact with the magnet 33 rolls back about the magnet in the direction of direction arrow 49, as shown in FIG. 2D. This rolling of the slug about the magnet is aided by the edge 28 of slot 23 urging the slug in the direction of arrow 45. As the carrier is moved to the position of FIG. 2E, the edge 28 of front wall 27 of the slot 23 separates or detaches the magnetic slug from the magnet 33 and the slug falls back into the slot in the direction of arrow 50. In this manner, rejected magnetic slugs are returned by the carrier 21 to the coin receiving station.

By using a magnet with an at least partly cylindrical outer surface, a rolling type contact between the edge of the magnetic slug and the magnet is maintained, helping the magnet to keep the slug lifted above the coin path and allowing the magnetic slug to roll back as the carrier is withdrawn. By using an elongated magnet having an axis of elongation which is transversely perpendicular to the direction of coin travel, one magnet can be used to detect and reject magnetic slugs in any of the various slots 23 as the slugs pass near to and below the magnet. This is particularly important where a great many coin slides in use today are configured to use two or more coins at once.

The stop 34 may be done away with in some circumstances. In that event, as the carrier continues to advance the magnetic slug, the magnetic slug continues to roll about the outer surface of the cylindrical magnet 33 until the lowermost surface of the slug is above the upper surface 16 of the carrier 21. The carrier may then continue to advance, but will not deliver the appropriate number of coins to the coin acceptance station. As the carrier 21 is withdrawn in the direction of direction arrow 45, the slug is driven back into the slot 23, with the slot rear wall 27 functioning much as a lug in detaching the slug from contact with the magnet.

It thus is seen that a coin slide is provided with a means for accepting nonmagnetic coins while rejecting magnetic slugs which is both simply made and effective and reliable in operation. It should be understood, however, that the just described embodiment merely illustrates principles of the invention in a preferred form and that many modifications, additions and deletions may be made thereto without departing from the spirit and scope of the invention as set forth in the following claims.

I claim:

1. A coin slide comprising:

a track having a carrier means mounted for reciprocal movement along said track for carrying a coin in a generally upright, on edge orientation along a path of travel from a coin receiving station through a coin rejection station to a coin acceptance station, said carrier means then being returnable to the coin receiving station, magnet means mounted adjacent said track at said coin rejection station for attracting and holding coins that contain magnetic material, said carrier means having a first coin engaging portion for urging an edge of a magnetic coin against said magnet means for causing the magnetic coin to pivot upwardly against said magnet means for raising the magnetic coin above the path of travel of said carrier means, and wherein said carrier means has a second coin engaging portion for engaging and detaching a magnetic coin held by said magnet means from said magnet means and returning the coin to said coin receiving station as said carrier means is returned thereto.

2. The coin slide as claimed in claim 1 further comprising stop means mounted at said coin rejection station above said coin path in spaced relation with said magnet means.

3. The coin slide as claimed in claim 2 wherein said coin slide is adapted to accept coins of a selected diameter and said stop means is positioned from said magnet means a distance less than the selected diameter of the coin whereby as the carrier means is advanced toward the coin acceptance station the magnetic coin is arrested by the stop means and the carrier means is arrested by the coin.

4. The coin slide as claimed in claim 1 wherein said magnet means comprises an arcuate surface.

5. The coin slide as claimed in claim 1 wherein said magnet means is mounted adjacent and above said path of coin travel.

6. The coin slide as claimed in claim 5 wherein said magnet means comprises an elongated cylindrical permanent magnet having a longitudinal axis generally perpendicular to said path of coin travel.

7. The coin slide as claimed in claim 1 wherein said carrier means for carrying a coin comprises slots for carrying two or more coins at once.

8. An attachment for use with a coin slide of the type adapted to be mounted to a vending machine and in which a slotted carrier is used to carry a coin in a generally upright, on edge orientation along a generally horizontal coin path between a coin receiving station and a coin acceptance station in which the coin or the carrier activates the vending machine to allow operation, with the coin slide being configured to allow only coins of a selected diameter to be used therein, the attachment comprising:

a coin slide having slots for carrying coins, said slots having front and rear sides serving as abutment means for urging the coins in a selected direction along the horizontal coin path, said front side being closest to said coin receiving station;

a cover adapted to be mounted to the coin slide above the coin path and comprising a coin rejection station intermediate the coin receiving and coin acceptance stations, magnet mean secured to said cover for lifting magnetic coins at least partly out of the coin path, and stop means secured to said cover and positioned from said magnet means a distance which is less than the selected diameter of the coin, whereby as a magnetic coin is lifted by the magnet means and rotates upwardly thereagainst, and as the carrier is moved farther along the coin path, said front side engages the magnetic coin which in turn engages the stop means and movement of the coin along the path is thereby arrested through the interaction of said front side, said stop means and said magnet means.

9. The attachment as claimed in claim 8 wherein said magnet means comprises an elongated cylindrical permanent magnet having an axis of elongation and mounted to said cover in a manner in which said axis of elongation is generally perpendicular to said coin path.

10. An attachment as defined in claim 8 in which when a magnetic coin has arrested movement of said slide toward said vending station and upon retraction of said slide toward said coin receiving station, said rear edge engages the magnetic coin and disengages the coin from contact with said stop means and said magnet means.

11. A coin slide configured for mounting to a vending machine and to accept coins of a selected diameter, comprising:

a housing;

a reciprocating carrier means moveable relative to the housing between a forward coin receiving station, an intermediate coin rejection station, and a rearward vending station, said carrier means being configured to carry a coin oriented on an edge thereof and generally vertically along a path of travel toward said rearward vending station, said carrier means having at least one coin receiving slot with front and rear edges for urging said coin along the path of travel of said carrier means, said front edge being closer to said coin receiving station relative to said rear edge; and magnetic coin rejecting means positioned at said coin rejection station and comprising an elongated magnet having an arcuate surface positioned above and adjacent said coin path for lifting a magnetic coin at least partly out of said coin path and holding it there to prevent the magnetic coin from being carried to the vending station by said carrier means while allowing nonmagnetic coins to pass thereunder, said front edge serving to engage the magnetic coin and maintain the edge of the magnetic coin in contact with said magnet, said magnetic coin rejecting means further comprising a stop means at said coin rejection station and spaced from said magnet less than the selected coin diameter for engaging the magnetic coin and in combination with said magnet and said front edge preventing further movement of said carrier means toward said vending station.

12. A coin slide as defined in claim 11 in which when a magnetic coin has arrested movement of said carrier means toward said vending station and upon retraction of said carrier means toward said coin receiving station, said rear edge engages the magnetic coin and disengages the coin from contact with said stop means and said magnet.

* * * * *